US010300346B2

(12) United States Patent
Hinnen, III

(10) Patent No.: US 10,300,346 B2
(45) Date of Patent: May 28, 2019

(54) DEFORMABLE TOY

(71) Applicant: John Hinnen, III, Peoria, IL (US)

(72) Inventor: John Hinnen, III, Peoria, IL (US)

( * ) Notice: Subject to any disclaimer, the term of this patent is extended or adjusted under 35 U.S.C. 154(b) by 0 days.

(21) Appl. No.: 15/885,552

(22) Filed: Jan. 31, 2018

(65) Prior Publication Data

US 2018/0221717 A1 Aug. 9, 2018

Related U.S. Application Data

(60) Provisional application No. 62/499,715, filed on Feb. 3, 2017.

(51) Int. Cl.

| | |
|---|---|
| ***A63B 43/04*** | (2006.01) |
| ***A63B 43/00*** | (2006.01) |
| ***A63B 39/00*** | (2006.01) |

(52) U.S. Cl.

CPC ..... *A63B 43/002* (2013.01); *A63B 39/00* (2013.01); *A63B 43/04* (2013.01); *A63B 2207/00* (2013.01); *A63B 2209/00* (2013.01)

(58) Field of Classification Search

CPC ..... A63B 43/002; A63B 39/00; A63B 43/04; A63B 2209/00

See application file for complete search history.

(56) References Cited

U.S. PATENT DOCUMENTS 115,252 A 5/1871 Spencer
513,560 A * 1/1894 Dickey ..... A63B 39/00 473/612
2,011,760 A 8/1935 Gallinant
2,338,274 A 1/1944 Yancey
2,791,868 A * 5/1957 Viken ..... A63H 33/062 428/11
2,952,460 A * 9/1960 Ellis ..... A63B 43/00 273/DIG. 25
3,046,016 A * 7/1962 Laws ..... A63F 3/00094 273/241
3,218,071 A * 11/1965 Richard ..... A63B 43/00 446/457
3,758,985 A 9/1973 Heisler
4,581,299 A * 4/1986 Jager ..... B01J 19/30 261/DIG. 72
4,794,024 A * 12/1988 Crowell ..... G09F 1/06 40/124.08

(Continued)

FOREIGN PATENT DOCUMENTS

FR 1307011 A * 10/1962 ..... A63B 43/00

*Primary Examiner* — Steven B Wong

(74) *Attorney, Agent, or Firm* — Singleton Law Firm, P.C.

(57) ABSTRACT

Embodiments of the present invention provide a toy deformable to several structural configurations. The toy includes two endcaps connected by a plurality of pliable ribs. The toy may be deformed into a low-profile configuration by pressing the endcaps together, the ribs bending outward to accommodate the deformation. The toy may be deformed into a high-profile configuration by squeezing the ribs together, the endcaps being pushed apart to accommodate the deformation. While pressure is not applied to the toy, the toy may enter a non-deformed configuration wherein the ribs and the toy as a whole take on a substantially spherical form. A retention device may also be utilized to confine the toy to a specific configuration.

7 Claims, 8 Drawing Sheets

(56) References Cited

U.S. PATENT DOCUMENTS

| | | | | | |
|---|---|---|---|---|---|
| 4,955,841 | A * | 9/1990 | Pastrano | A63H 33/18 | 446/46 |
| 5,096,751 | A * | 3/1992 | Duchek | B42D 15/042 | 40/124.08 |
| 5,797,815 | A * | 8/1998 | Goldman | A63H 33/18 | 446/46 |
| 5,937,553 | A * | 8/1999 | Maran | G09F 1/06 | 40/124.08 |
| D434,457 | S * | 11/2000 | Goldman | D21/440 | |
| D441,407 | S * | 5/2001 | Goldman | D21/398 | |
| 6,237,773 | B1 * | 5/2001 | Goldman | A63H 33/00 | 206/476 |
| 6,622,659 | B2 | 9/2003 | Willinger | | |
| 6,746,351 | B1 * | 6/2004 | Goodman | A63B 39/00 | 473/596 |
| 6,805,077 | B2 * | 10/2004 | Goldman | A01K 15/025 | 119/707 |
| 6,863,588 | B1 * | 3/2005 | Chu | A63B 43/00 | 446/46 |
| 6,896,577 | B1 * | 5/2005 | Feng | A63H 33/18 | 446/46 |
| 7,234,253 | B2 * | 6/2007 | Ossmann | G09F 1/06 | 40/124.03 |
| 7,546,702 | B2 * | 6/2009 | Malkovas | G09F 1/08 | 40/124.08 |
| 7,914,405 | B1 * | 3/2011 | Scheffler | A01K 15/026 | 119/707 |
| 10,112,121 | B2 * | 10/2018 | Tiefel | A63H 33/18 | |
| 2006/0084355 | A1 | 4/2006 | Wong et al. | | |

* cited by examiner

DEFORMABLE TOY

CROSS-REFERENCE TO RELATED APPLICATIONS

This application claims the benefit of U.S. Provisional Application No. 62/499,715, filed Feb. 3, 2017.

BACKGROUND OF THE INVENTION

In toy manufacturing, it is known to manufacture a toy with a rigid or substantially rigid structure for throwing. Round balls are manufactured to exhibit qualities such as bouncing, curving while in flight, or wobbling while rolling. Footballs are manufactured with tapered shape to be thrown long distances in spiraling motions. Throwing discs are manufactured with flat, aerodynamic profiles to be thrown in spinning motions. Such toys may be substantially solid in structure, or otherwise rigid and minimally deformable.

Furthermore, it is known to manufacture a toy with a hollowed structure from elastomeric materials. U.S. Pat. No. 6,622,659 to Willinger discloses spherical animal toys formed for the purpose of rolling and bouncing in the manner of a ball toy. Willinger's toy may further be compressed into a compact profile to be packaged during shipping, though Willinger discloses no advantages of such a compact profile during use of the toy.

Toys having hollowed structures have not been made to realize further qualities that may be achieved during their use from having hollowed structures, nor further qualities that may be achieved during their use through manufacturing using elastomeric materials.

BRIEF DESCRIPTION OF THE INVENTION

Embodiments of the present invention provide a toy deformable to several structural configurations. The toy includes two endcaps connected by a plurality of pliable ribs.

A user may squeeze the toy about each of the ribs to push the ribs together while pushing the endcaps apart. The toy may consequently take on an elongated spheroid structure. A user may press the endcaps towards each other so that each of the ribs bends outwards. The toy may consequently take on a flattened spheroid structure. While pressure is not applied to the toy, the toy may take on a substantially spherical structure.

The toy may have an equator defined about a circumference substantially midway between the first endcap and the second endcap. The toy may be held in a high-profile configuration by fastening a retainer about the equator. The toy may be held in a low-profile configuration by fastening a retainer about a plurality of ribs nearer to the first endcap, and about a plurality of ribs nearer to the second endcap.

The toy may be used while held in a non-deformed configuration; in a low-profile configuration; or in a high-profile configuration.

DETAILED DESCRIPTION OF THE INVENTION

Figure 1A:
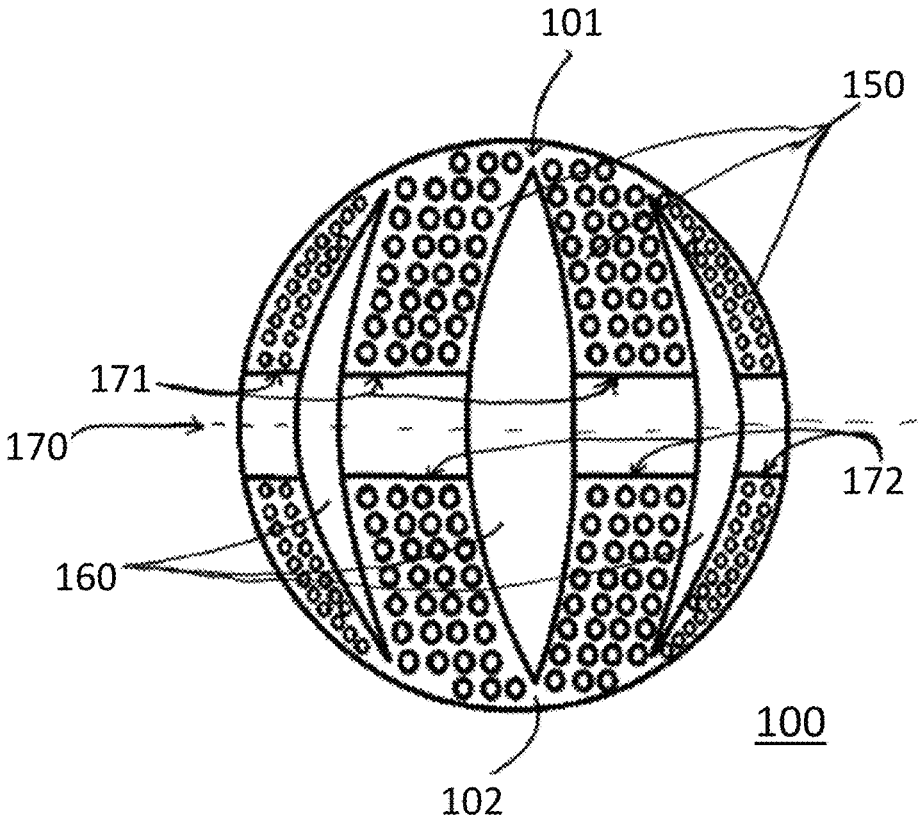
FIG. 1A illustrates a perspective view of a deformable toy in a non-deformed configuration.

FIG. 1A illustrates a perspective view of a deformable toy 100 according to an embodiment of the present invention. The toy 100 has a first endcap 101 and a second endcap 102 set on opposing ends of the toy 100. Each endcap 101 and 102 may take on the form of a dome like structure while the toy 100 is in a non-deformed profile. According to some embodiments of the present invention, each endcap 101 and 102 may have an outer face substantially solid and even in profile. An outer face of an endcap 101 and 102 may bear markings or ornamentation.

Figure 1B:
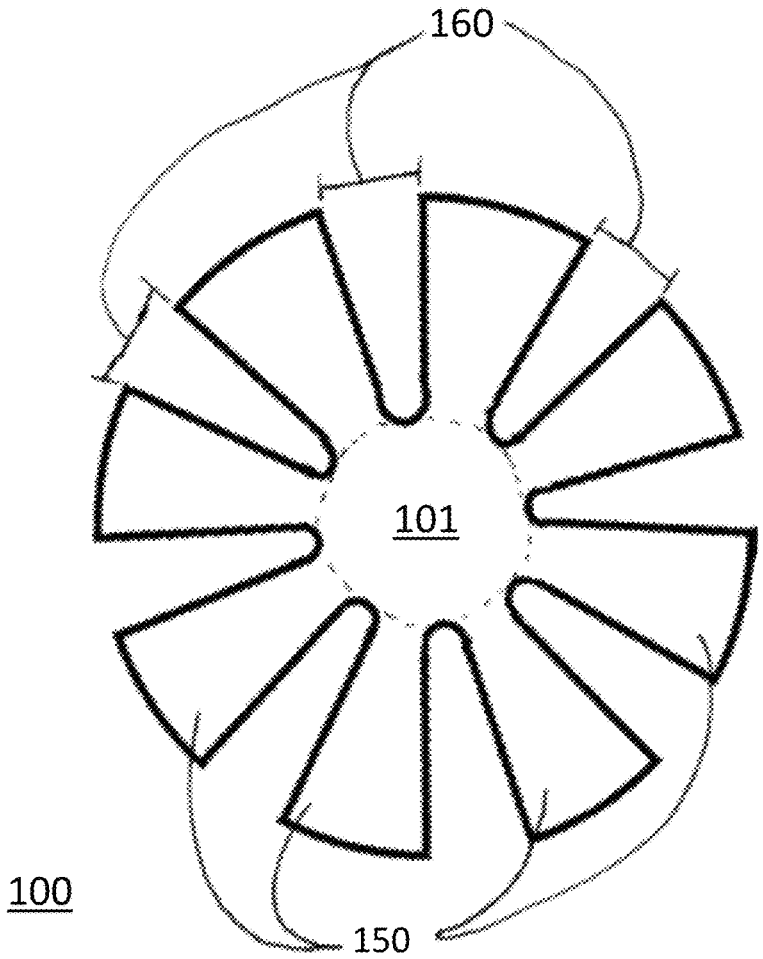
FIG. 1B illustrates a profile view of the deformable toy in a non-deformed configuration.

A plurality of ribs 150 each connect to both the first endcap 101 at a first end of a rib 150 and to the second endcap 102 at a second end of a rib 150. Each rib 150 may take on a substantially wedge-shaped form while the toy is in a non-deformed profile, such that a wedge-shaped gap 160 occurs between adjacent ribs 150. A gap 160 may be pointed or rounded at either end of its wedge shape (as illustrated in FIG. 1B). The wedge shape of a gap 160 may be smaller in proportion to the wedge shape of a rib 150 such that the rib 150 at its widest point is wider than the gap 160 at its widest point.

Each rib 150 may have an outer face substantially uneven in profile. An outer face of a rib 150 may comprise a pattern of uneven texture, including but not limited to, bumps, ridges, or grooves.

The deformable toy 100 may have an equator 170 defined about a circumference substantially midway between the first endcap 101 and the second endcap 102. The equator 170 may span across the lengthwise substantially median region of each rib 150. On each rib 150, a first circumferential ridge 171 may span across the outer face of the rib 150 at the side of the equator 170 towards the first endcap 101, and a second circumferential ridge 172 may span across the outer face of the rib 150 at the side of the equator 170 towards the second endcap 102.

While pressure is not applied to the deformable toy 100, the toy 100 may take on a substantially spherical structure, as shown in FIG. 1A, defined by each of the ribs 150 forming a partial wedge section of the spherical structure. Gaps 160 permit access to the hollowed interior of the spherical structure.

The ribs 150 may be sufficiently pliable such that pushing adjacent ribs 150 together may narrow the gap 160 between the adjacent ribs 150, and pulling adjacent ribs 150 apart may widen the gap 160 between the adjacent ribs 150. Thus, an object may be placed inside the toy 100 through a gap 160 while the gap 160 is not narrowed, and subsequently may be retained inside the toy 100 while the gap 160 is narrowed.

Figure 2A:
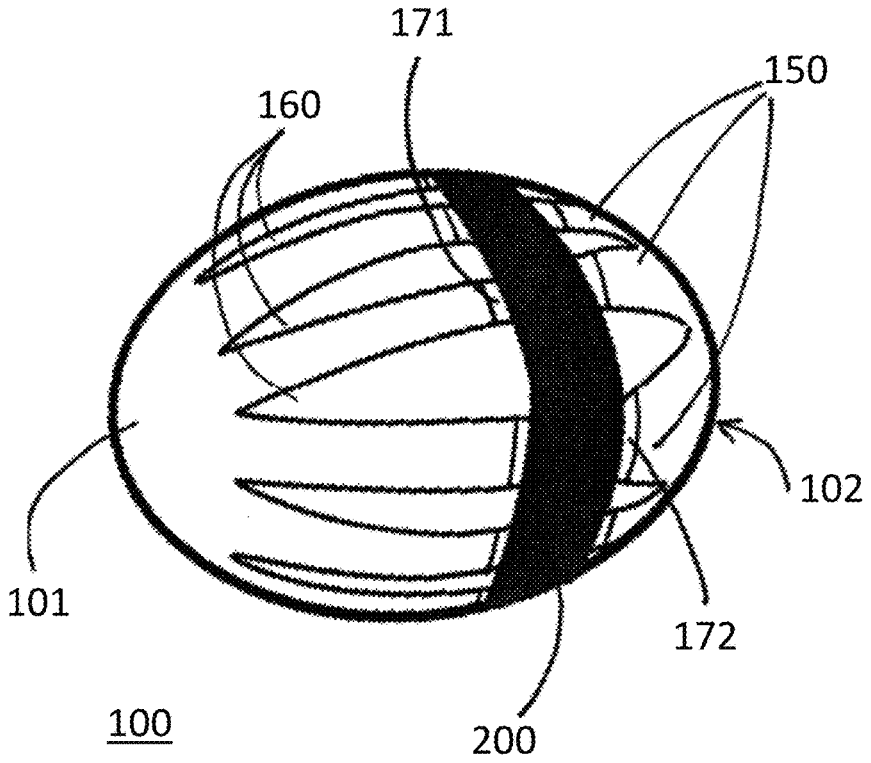
FIG. 2A illustrates a perspective view of the deformable toy in a high-profile configuration.
Figure 2B:
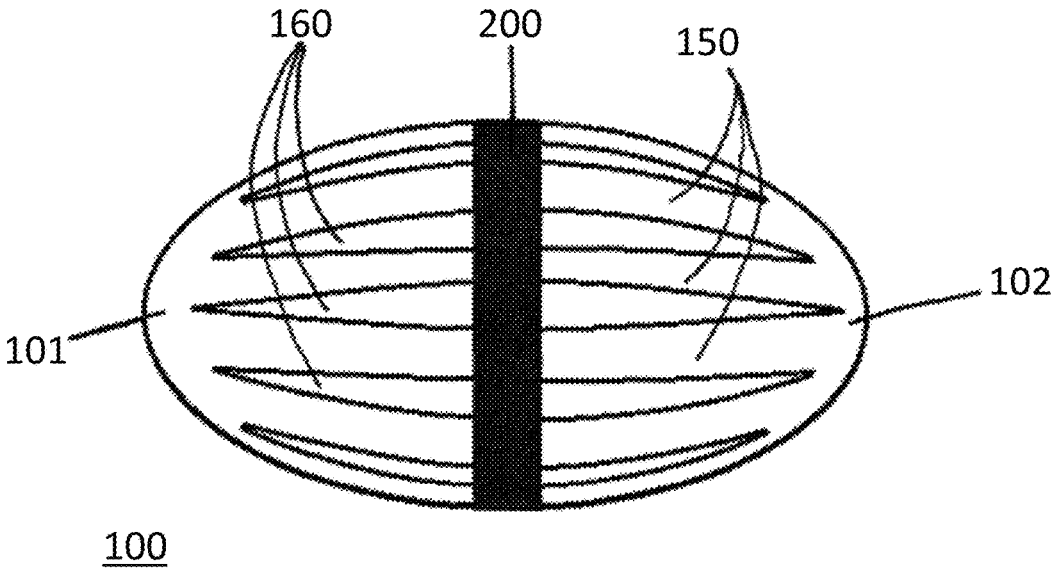
FIG. 2B illustrates a profile view of the deformable toy in a high-profile configuration.

FIGS. 2A-B illustrates the toy 100 deformed in a high-profile configuration. A user may squeeze the toy about each of the ribs 150 to push the ribs 150 together while pushing the endcaps 101 and 102 apart. The toy 100 may consequently take on an elongated spheroid structure.

The toy 100 may be held in a high-profile configuration by fastening a retainer 200 about the equator 170. The retainer 200 may be a flexible loop such as an elastomeric band disposed to pull taut to a circumference smaller than the circumference of the toy 100 at the equator 170 while the toy is in a non-deformed configuration. Thus, the retainer 200 may be disposed to hold the ribs 150 together such that the gaps 160 remain narrowed. For example, the retainer 200 may be a wristband wearable by a user while not fastened about the toy 100.

The first circumferential ridge 171 and the second circumferential ridge 172 may tend to hold the retainer 200 in place at the equator (not shown) therebetween.

Figure 3A:
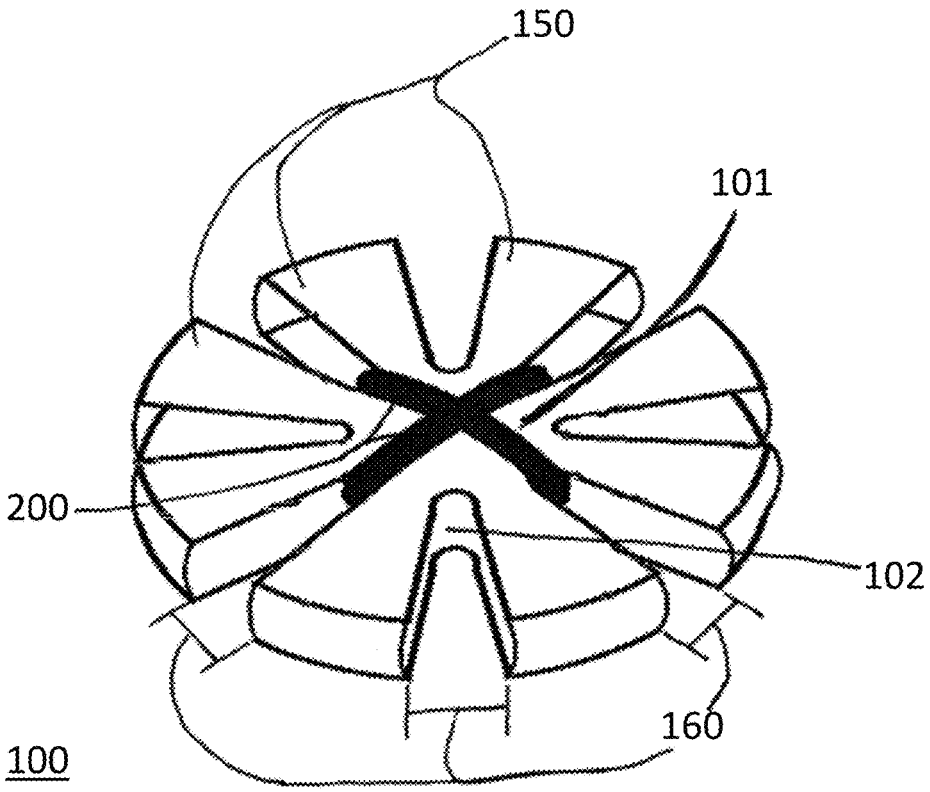
FIG. 3A illustrates a perspective view of the deformable toy in a low-profile configuration.
Figure 3B:
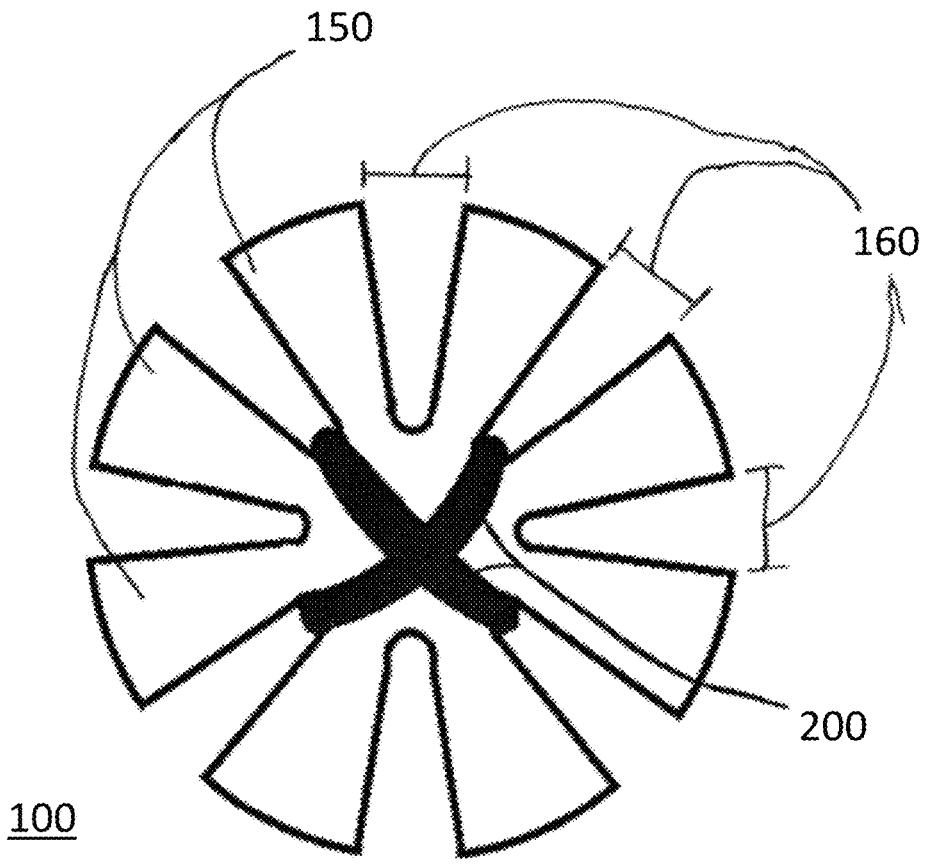
FIG. 3B illustrates a profile view of the deformable toy in a low-profile configuration.

FIGS. 3A-B illustrates the deformable toy 100 deformed in a low-profile configuration. A user may press the endcaps 101 and 102 towards each other so that each of the ribs 150 bends outwards. Bending the ribs 150 outwards may widen each of the gaps 160. The toy 100 may consequently take on a flattened spheroid structure.

The deformable toy 100 may be held in a low-profile configuration by fastening a retainer 200 about a plurality of ribs 150 nearer to the first endcap 101, and about a plurality of ribs 150 nearer to the second endcap 102. For example, the ribs 150 may be divided among a first set of ribs and a second set of ribs. The retainer 200 may wind about the first set of ribs 150 at their ends connected to the first endcap 101, and may wind about the second set of ribs 150 at their ends connected to the second endcap 102. In between adjacent ribs 150, the retainer 200 may wind from an end of a rib 150 connected to the first endcap 101 to an end of a rib 150 connected to the second endcap 102; may wind from an end of a rib 150 connected to the second endcap 102 to an end of a rib 150 connected to the first endcap 101; may wind from an end of a rib 150 connected to the first endcap 101 to an end of another rib 150 connected to the first endcap 101; or may wind from an end of a rib 150 connected to the second endcap 102 to an end of another rib 150 connected to the second endcap 102.

In some embodiments of the invention, the deformable toy 100 may be manufactured in multiple pieces and joined by chemical welding, frictional fitting, heat fusion, or other industry-standard methods known in the art. For example, the toy 100 may be manufactured in two pieces representing hemispherical counterparts of the toy 100's spherical structure, which are coupled across the equator 170 of the toy 100. Pieces of the toy 100 may be molded from elastomeric materials sufficiently rigid to hold configurations as specified herein while sufficiently pliable to permit bending and deformation as specified herein. In other embodiments of the invention, the toy may be manufactured in multiple pieces with the endcaps being coupled to the plurality of ribs along an outer edge of each endcap, allowing for endcaps with different ornamental surface features to be interchangeable within the manufacturing process.

The deformable toy 100 may be used while in a non-deformed configuration; in a low-profile configuration; or in a high-profile configuration. Held in a non-deformed configuration, the spherical structure of the toy 100 may enhance the capacity of the toy 100 to be thrown in an arc; rolled; hit with a striking implement such as a bat, paddle, or racquet; or aimed at targets such as hoops. A weighted object may be held within the toy 100 while the toy 100 is held in a non-deformed configuration, altering the motions of the toy 100 while thrown, rolled, hit, or aimed.

Held in a high-profile configuration, the deformable toy 100 may be thrown in a spiraling motion. The elongated spheroid structure of the toy 100 may be conducive to spiraling thrown motions. A weighted object may be held within the toy 100 while the toy 100 is held in a high-profile configuration, altering the motions of the toy 100 while thrown.

Held in a low-profile configuration, the deformable toy 100 may be thrown in a spinning motion. The flattened spheroid structure of the toy 100 may be conducive to spinning thrown motions. A weighted object may be held within the toy 100 while the toy 100 is held in a low-profile configuration, altering the motions of the toy 100 while thrown.

In some embodiments of the present invention, the deformable toy may further comprise a roughened texture to facilitate gripping by a user.

In some embodiments of the present invention the deformable toy may comprise surfaces configured with decorative elements disposed thereupon. A decorative element may be imprinted, molded, or stamped on a surface such as the first endcap or the second endcap. A decorative or ornamental element may be imprinted, molded, or stamped, spanning each of the ribs as a whole surface such that the pieces of the decorative or ornamental element are united while the toy is held in a high-profile configuration.

In some embodiments of the present invention the deformable toy may be placed in multiple configurations during use and play by a user. A user may use a common flexible wearable article such as a wristband as a retainer to hold the toy in any of the toy's possible configurations.

Figure 4A:
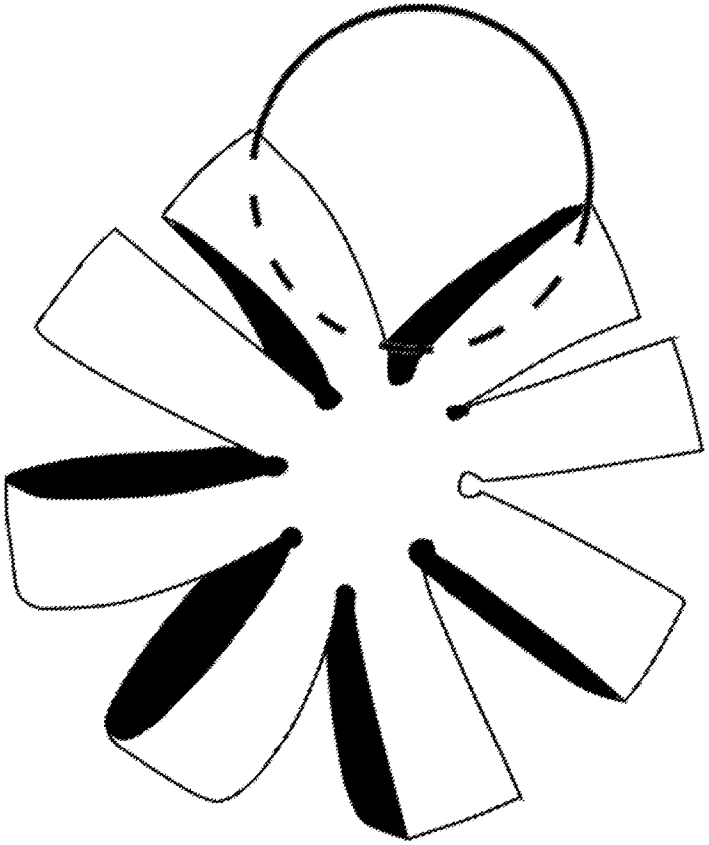
FIG. 4A illustrates a perspective view of an object being inserted into the deformable toy.
Figure 4B:
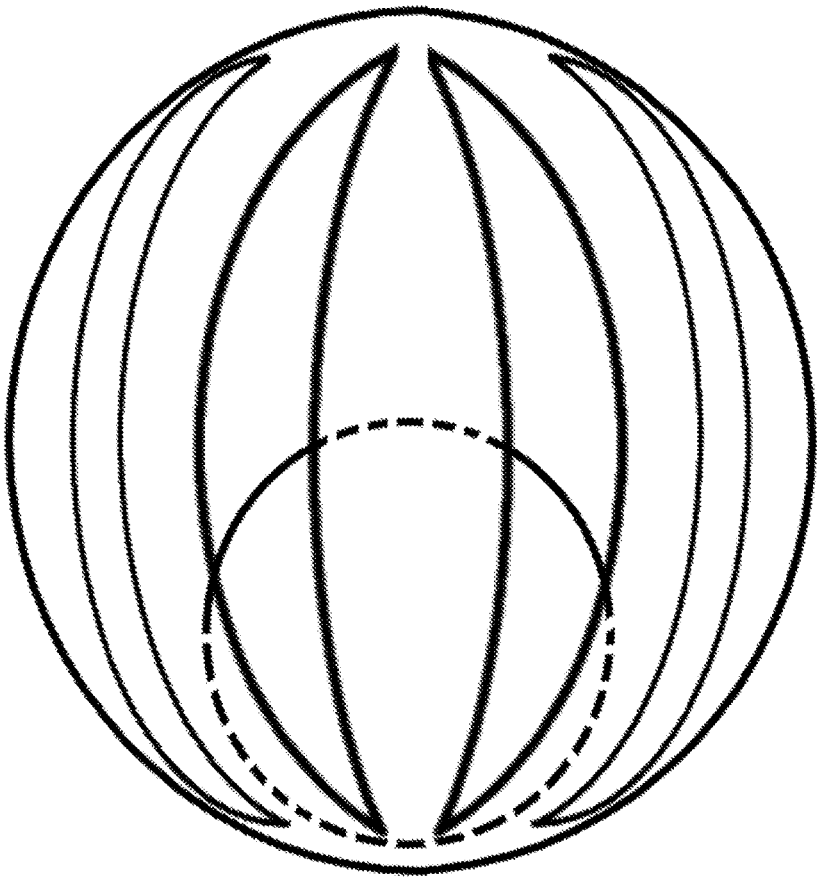
FIG. 4B illustrates a perspective view of the deformable toy containing an object inserted within.

In some embodiments of the present invention, as shown in FIGS. 4A-B, the deformable toy may function as a container for holding objects such as other toys, prizes, printed matter, weighted objects, or luminous objects. Thus, a toy as presented by the proceeding embodiments of the present invention may be used as a container for distribution of other objects; may be adjustable in weight if a weighted object is placed inside; and may emit light if a luminous object is placed inside.

While particular elements, embodiments, and applications of the present invention have been shown and described, the invention is not limited thereto because modifications may be made by those skilled in the art, particularly in light of the foregoing teaching. It is therefore contemplated by the application to cover such modifications and incorporate those features which come within the spirit and scope of the invention.

What is claimed is:

1. A deformable toy, comprising:

a. a first solid endcap;

b. a second solid endcap;

c. a removeable retainer;

d. a plurality of ribs, wherein at least one rib connects the first solid endcap and the second solid endcap and at least one rib comprises an outer face having an uneven texture;

e. an equator spanning across at least one rib of the plurality of ribs, the equator having a first circumferential ridge and a second circumferential ridge each spanning the plurality of ribs to respective sides of the equator;

f. at least one gap configured to separate at least one rib from another adjacent rib;

g. wherein at least one rib of the plurality of ribs is bendable outward away from a central axis of the toy;

h. wherein the toy is capable of comprising, at a given time, one of either a non-deformed configuration, a low-profile configuration, and a high-profile configuration; the high-profile configuration defined by decreasing the gap via compression of the toy along a horizontal axis and the low-profile configuration defined by widening the gap via compression of the toy along a vertical axis; and i. wherein the removeable retainer is configured to couple and hold taut the equator, such that the toy is retained in the high-profile configuration.

2. The deformable toy of claim 1, further comprising a substantially spherical structure while in the non-deformed state.

3. The deformable toy of claim 1, further comprising an elongated spheroid structure while in the high-profile configuration.

4. The deformable toy of claim 1, further comprising a flattened spheroid structure while in the low-profile configuration.

5. The deformable toy of claim 1, wherein the removeable retainer is further configured to couple and hold at least two ribs of the plurality of ribs together such that the toy is retained in the low-profile configuration.

6. The deformable toy of claim 1, wherein at least one rib of the plurality of ribs is sufficiently bendable outward such that at least one object may be removably inserted into an interior of the deformable toy.

7. The deformable toy of claim 6, wherein the at least one object removably inserted into an interior of the deformable toy comprises a luminous object.

* * * * *